US009045930B2

(12) United States Patent
Olson et al.

(10) Patent No.: US 9,045,930 B2
(45) Date of Patent: Jun. 2, 2015

(54) ELECTRIC CIRCUIT WITH SPEED CONTROL AND DIODE SEPARATION FOR USE WITH AN ELECTRICALLY ACTUATABLE MECHANISM

(75) Inventors: Matthew Olson, Maple Grove, MN (US); Paul Kubinski, Brooklyn Park, MN (US); Romell Alaman, Prairie, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 888 days.

(21) Appl. No.: 13/090,456

(22) Filed: Apr. 20, 2011

(65) Prior Publication Data

US 2012/0090307 A1 Apr. 19, 2012

Related U.S. Application Data

(60) Provisional application No. 61/327,154, filed on Apr. 23, 2010.

(51) Int. Cl.
*E05F 15/00* (2006.01)

(52) U.S. Cl.
CPC ..... *E05F 15/50* (2015.01); *E05Y 2400/36* (2013.01); *E05Y 2400/40* (2013.01); *E05Y 2400/452* (2013.01); *E05Y 2900/51* (2013.01); *E05F 15/53* (2015.01); *E05F 15/565* (2015.01)

(58) Field of Classification Search
CPC ..... E05Y 2400/452
See application file for complete search history.

(56) References Cited

U.S. PATENT DOCUMENTS

| | | | | |
|---|---|---|---|---|
| 3,763,744 | A | 10/1973 | Fournell et al. | |
| 4,007,361 | A | 2/1977 | Martin | |
| 4,386,553 | A | 6/1983 | Thoman et al. | |
| 4,508,176 | A | 4/1985 | Wiegardt et al. | |
| 4,651,128 | A | 3/1987 | Kolb | |
| 4,726,627 | A | 2/1988 | Frait et al. | |
| 4,728,264 | A | 3/1988 | Tuckey | |
| 4,910,682 | A * | 3/1990 | Wolff et al. | 417/22 |
| 5,231,722 | A | 8/1993 | Shacklock et al. | |
| 5,505,043 | A * | 4/1996 | Baginski et al. | 60/477 |
| 6,708,552 | B2 | 3/2004 | Weldon | |
| 6,983,641 | B1 | 1/2006 | Perry et al. | |
| 2006/0196757 | A1 | 9/2006 | Choi | |
| 2009/0152077 | A1 | 6/2009 | Lee et al. | |

* cited by examiner

*Primary Examiner* — F. Daniel Lopez
(74) *Attorney, Agent, or Firm* — Renner, Otto, Boisselle & Sklar, LLP.

(57) ABSTRACT

An electric circuit with speed control and diode separation for use with an electrically actuatable mechanism. An operator input provides a signal to a controller of the electric circuit. The controller causes a MOSFET relay to provide a voltage to the electrically actuatable mechanism. The relay is adapted to vary the voltage in response to pulse width modified signals from the controller.

5 Claims, 3 Drawing Sheets

ELECTRIC CIRCUIT WITH SPEED CONTROL AND DIODE SEPARATION FOR USE WITH AN ELECTRICALLY ACTUATABLE MECHANISM

CROSS REFERENCE TO RELATED APPLICATIONS

The present application claims the benefit of the filing date of U.S. Provisional Patent Application Ser. No. 61/327,154, filed Apr. 23, 2010, the disclosure of which is incorporated herein by reference in its entirety.

FIELD OF INVENTION

The present invention relates to an electric circuit with speed control and diode separation for use with an electrically actuatable mechanism. In one embodiment, the electrically actuatable mechanism is an electro-hydraulic actuator of a door assist system.

BACKGROUND OF THE INVENTION

It is known to use an electrically actuatable mechanism to move a heavy object, such as a heavy door. One such mechanism is an electro-hydraulic actuator.

FIG. 1 is a schematic illustration of a conventional electro-hydraulic actuator 10. The electro-hydraulic actuator 10 includes an electric motor 12 that is operatively coupled to a hydraulic pump 14. The electric motor 12 is operable for driving the hydraulic pump 14 in opposite first and second rotational directions. The hydraulic pump 14 draws fluid from a reservoir 16 and provides the fluid to an actuator 18. The actuator 18 includes a piston 24 that is movably mounted within a cylinder bore 26. The piston 24 divides the cylinder bore 26 into first and second chambers 28 and 30, respectively. The first chamber 28 may be referred to as a piston (or head) side chamber and, the second chamber 30 may be referred to as a rod side chamber. A rod 32 of the actuator 18 which is affixed to or integral to the piston 24 extends through the second chamber 30 and outwardly of a housing (not shown) of the electro-hydraulic actuator 10. Commonly, the electric motor 12, the hydraulic pump 14, the reservoir 16 and the actuator 18 are integrated into a single, compact package.

The electro-hydraulic actuator 10 is operable for extending or retracting the rod 32 for causing relative movement of two structures, one attached to the housing of the package and the other attached to the end of the rod. For example, in a door assist system associated with a vehicle, extending and retracting the rod 32 moves the door relative to the vehicle body. To extend the rod 32 of the electro-hydraulic actuator 10, the electric motor 12 is operated to drive the hydraulic pump 14 in a first rotational direction causing hydraulic fluid drawn from the reservoir 16 and chamber 30 to be directed into the first chamber 28 of the actuator 18. The fluid directed into the first chamber 28 creates a pressure differential between the first and second chambers 28 and 30 of the actuator 18 that moves the piston 24 to increase the volume of the first chamber 28 and decrease the volume of the second chamber 30, thus extending the rod 32. To retract the rod 32, the electric motor 12 is operated to drive the hydraulic pump 14 in a second rotational direction, opposite the first rotational direction, causing hydraulic fluid drawn from the chamber 28 to be directed into the second chamber 30 of the actuator 18. The fluid directed into the second chamber 30 creates a pressure differential in which the pressure in the second chamber is higher than that in the first chamber 28. As a result of the differential pressure, the piston 24 moves to increase the volume of the second chamber 30 and decrease the volume of the first chamber 28, thus retracting the rod 32.

SUMMARY

At least one embodiment of the invention provides an electric circuit for actuating an electrically actuatable mechanism comprising: a controller, an operator input that when actuated provides a signal to the controller; a relay adapted to provide a voltage to the electrically actuatable mechanism in response to a signal from the controller, the relay adapted to vary the voltage in response to the signal, wherein the controller is adapted to provide the relay with signals for varying the voltage.

At least one embodiment of the invention provides an electric circuit for actuating an electrically actuatable mechanism comprising: a controller; multiple operator inputs each of which, when actuated, provides a signal to the controller; a relay adapted to provide a voltage to the electrically actuatable mechanism in response to a signal from the controller, wherein the relay also operates to control the signal to the controller in response to actuation of one of the operator inputs, a diode associated with each operator input and the electrically actuatable mechanism preventing a back-feeding of the voltage from the relay.

At least one embodiment of the invention provides an electro-hydraulic actuator system comprising: an actuator cylinder; an electric motor operatively coupled to a hydraulic pump; a reservoir of hydraulic fluid; and an electric circuit for actuating the actuator cylinder, the circuit comprising a controller, an operator input that when actuated provides a signal to the controller, a relay adapted to provide a voltage to the electrically actuatable mechanism in response to a signal from the controller, the relay adapted to vary the voltage in response to the signal, wherein the controller is adapted to provide the relay with signals for varying the voltage.

At least one embodiment of the invention provides a method of operating an electro-hydraulic actuator system comprising an actuator cylinder, an electric motor operatively coupled to a hydraulic pump, a reservoir of hydraulic fluid, and an electric circuit including a controller for actuating the actuator cylinder, comprising the steps of: providing an operator input that when actuated provides a signal to the controller, providing a voltage through a relay to the actuator in response to the signal from the controller, varying the voltage in response to the signal, wherein the controller is adapted to provide the relay with signals for varying the voltage.

BRIEF DESCRIPTION OF THE DRAWINGS

Embodiments of this invention will now be described in further detail with reference to the accompanying drawings, in which.

DETAILED DESCRIPTION

The present invention relates to electrical circuit designs that may be incorporated into the electrical circuit for actuating a mechanism such as, for example, an electro-hydraulic actuator used in a door assist system. The fundamental operation of a door assist system is to open and/or dose a door when the proper input is provided. Commonly, the proper input is provided by an operator actuating an open/close rocker switch.

Figure 1:
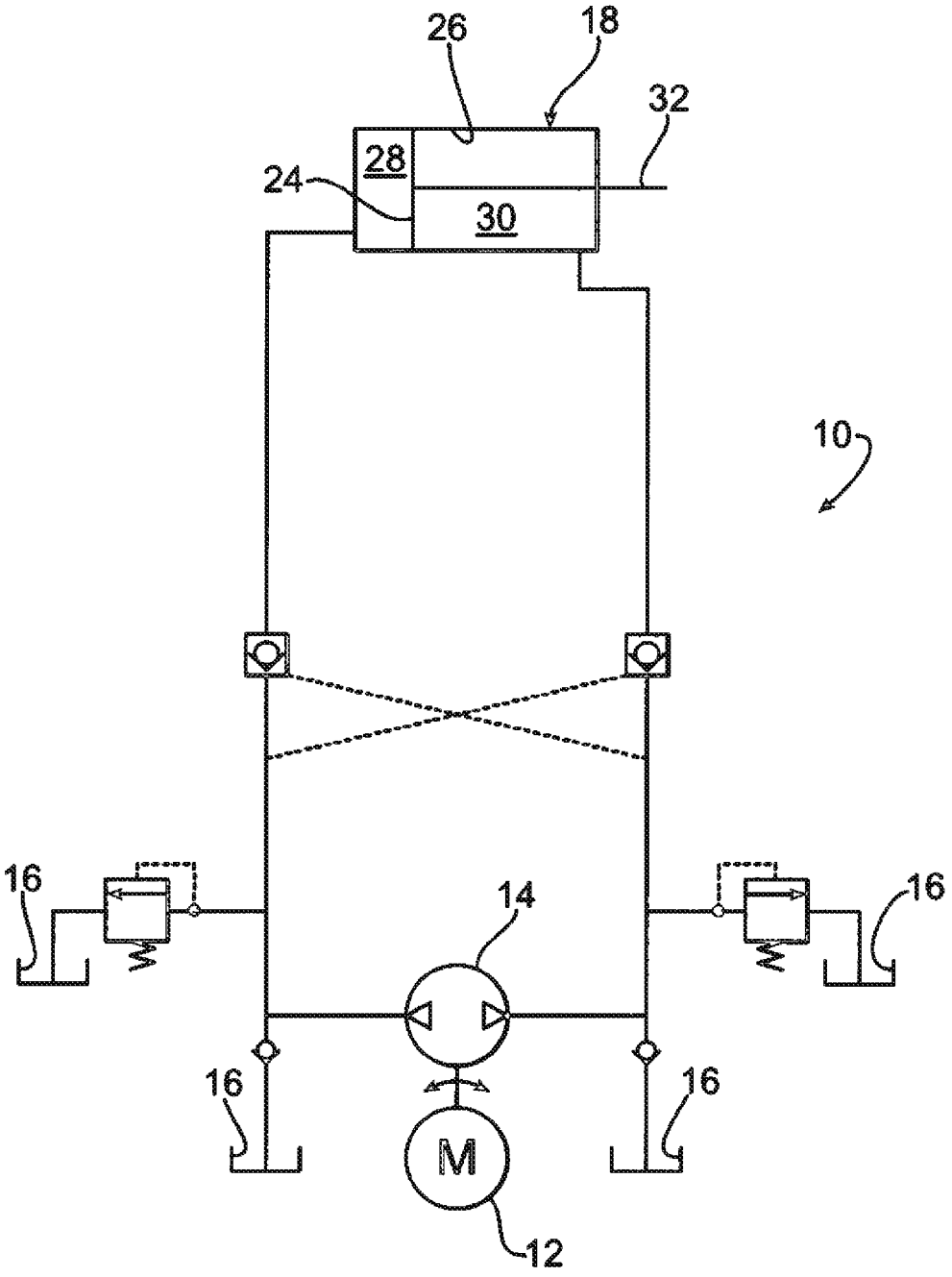
FIG. 1 (PRIOR ART)
FIG. 1 is a schematic view of a prior art electro-hydraulic actuator.
Figure 2:
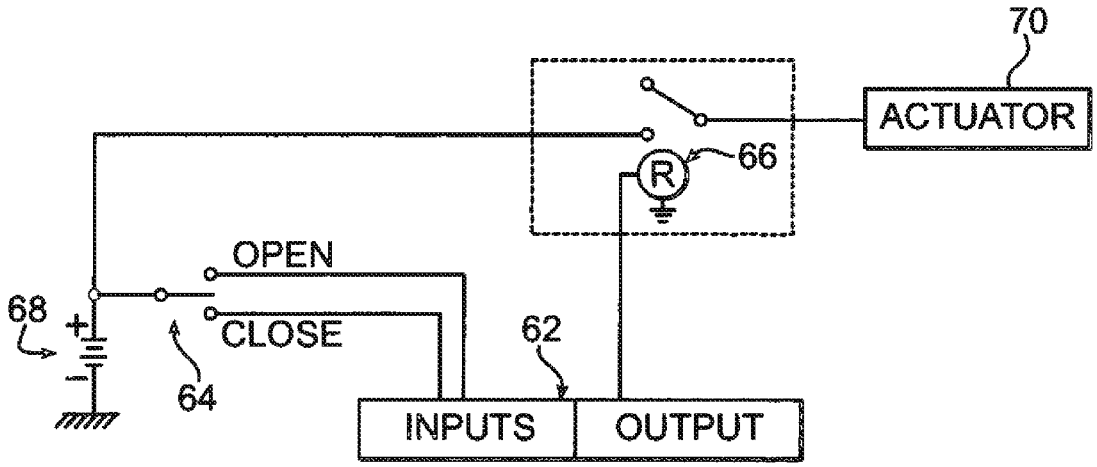
FIG. 2 (PRIOR ART)
FIG. 2 is a schematic view of a prior art electrical circuit of the type associated with the actuator of FIG. 1.

As shown in FIG. 2, in a conventional electrical circuit used in, for example, a door assist system, an input is given to a controller 62 via the closing of the rocker switch 64 by the operator. By closing the rocker switch 64, a signal is applied to the controller 62 and, in response to the signal, the controller 62 applies an output voltage to a relay 66 allowing power to flow from a battery 68 to the electrically actuatable mechanism 70.

The challenge with this conventional design is that as soon as the relay is closed, full voltage is applied to the electrically actuatable mechanism 70 and the load (such as the door) immediately begins moving. This may give the operator the appearance that the load is running away, and can also impart a "bouncing" of the load due the sudden movement of the mechanism, particularly when the mechanism imparts an impact force against the load. To address this issue, the electrical circuit of the present invention includes speed control capabilities.

Figure 3:
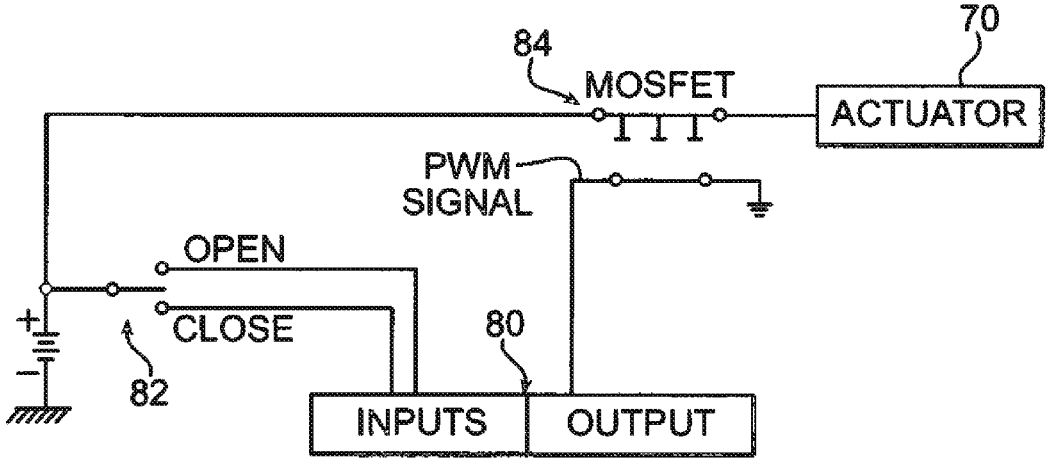
FIG. 3 is a schematic view of an embodiment of an electric circuit of the present invention utilizable with the actuator of FIG. 1.

FIG. 3 illustrates an electrical circuit constructed in accordance with a first embodiment of the present invention and including the speed control capabilities. In the electrical circuit of FIG. 3, the controller 80 is responsive to the operator closing the rocker switch 82 for providing a Pulse-width Modulated (PWM) output signal to a MOSFET relay 84. The controller 80 is operable to gradually start and stop the actuation of the mechanism 70 (such as the electro-hydraulic actuator 10) by ramping the voltage provided to the mechanism through control of the PWM signal. Another added function is the ability to have complete speed control of the mechanism 70 as a function of the PWM signal applied. As the PWM output signal provided by the controller 80 may be easily modified, the user has the ability to modify the speed control as desired. An added benefit of the electric circuit of FIG. 3 is that it utilizes only one MOSFET relay and thus, is simple and robust.

In order to save power, it is desirable for a door assist system, for example, to shut down a predetermined time after being actuated. When the system is shut down, or idle, it is expected that it will become active almost immediately upon an input by the operator (e.g., closing of the rocker switch 90). To accomplish this power savings, in a conventional system, the voltage signal applied by the user input is used to close an associated relay 92 or 94 with this relay thereafter applying a voltage to the controller 62 for activating the controller. An exemplary circuit showing this design is provided in FIG. 4. When activated, the controller 62 will keep the relay closed for the required time by applying voltage to the relay through an output.

Figure 4:
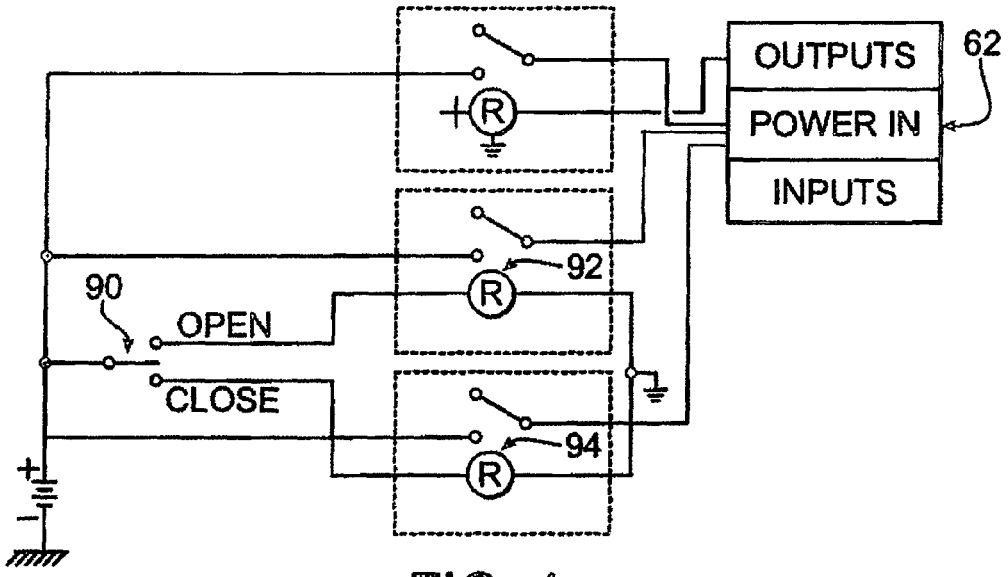
FIG. 4 (PRIOR ART)
FIG. 4 is a schematic view of a prior art electrical power activation circuit of the type associated with the actuator of FIG. 1.

Many systems, such as a door assist system, has multiple user inputs for activating the system. When multiple user inputs are used, the electric circuit can get very complex with a need for a dedicated relay for each of the user inputs and each voltage output, as illustrated in FIG. 4. The reason for having separate inputs is to avoid the risk of back-feeding voltage into one of the other inputs or the output of the controller.

Figure 5:
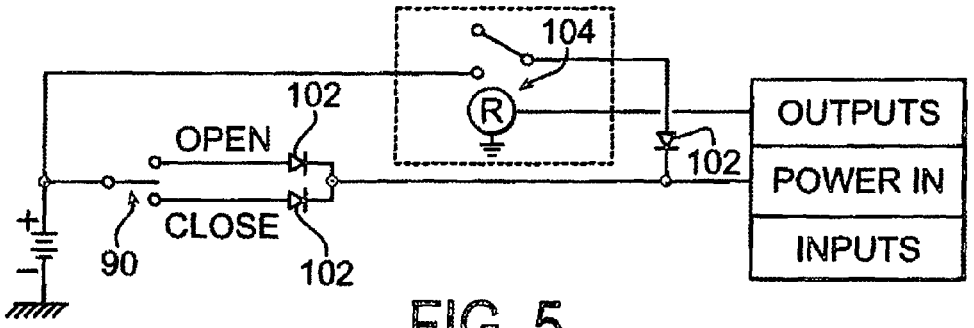
FIG. 5 is a schematic view of an embodiment of an electric power activation circuit of the present invention utilizable with the actuator of FIG. 1.

To address this issue with fewer components, the electric circuit of the present invention, as shown in FIG. 5, incorporates diodes 102 in each of the lines leading to the relay 104. This allows all three signal lines to pass through the same relay, thus reducing components, space and complexity of the system.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

What is claimed is:

1. An electric circuit for actuating an electrically actuatable mechanism comprising:

a controller;

multiple operator inputs each of which, when actuated, changes a boolean signal to the controller;

a first relay adapted to provide a voltage to the electrically actuatable mechanism in response to a control signal from the controller, a second relay electrically connected to an output of the controller and operative to control power to the controller in response to actuation of one of the operator inputs, a respective diode associated with each operator input, wherein each diode is associated with the second relay preventing a back-feeding of the voltage from the second relay.

2. The electric circuit of claim 1 wherein the first relay is adapted to vary the voltage in response to the control signal from the controller and the controller in response to the boolean signal is adapted to control the control signal to ramp a voltage provided through the first relay to the electrically actuatable mechanism from a first voltage to a second voltage to regulate a speed of the electrically actuatable mechanism.

3. The electric circuit of claim 1 or 2 wherein the control signal from the controller is a pulse width modulated signal.

4. The electric circuit of claim 1 or 2 wherein the first relay is a MOSFET relay.

5. The electric circuit of claim 1 or 2 wherein a diode is positioned in a line leading to the second relay.

* * * * *